United States Patent [19]

Chalabian

[11] 4,227,604

[45] Oct. 14, 1980

[54] COIN SELECTING FUNNEL

[75] Inventor: Jack S. Chalabian, Gardena, Calif.

[73] Assignee: K-Jack Engineering Company, Inc., Gardena, Calif.

[21] Appl. No.: 23,835

[22] Filed: Mar. 26, 1979

[51] Int. Cl.[3] ..... G07F 3/04

[52] U.S. Cl. ..... 194/102; 133/3 D; 194/1 K

[58] Field of Search ..... 194/102, 1 K; 133/3 D

[56] References Cited

U.S. PATENT DOCUMENTS

| | | | |
|---|---|---|---|
| 1,433,942 | 10/1922 | Doldt | 133/3 D |
| 1,935,662 | 11/1933 | Petersen | 194/102 |
| 2,222,863 | 11/1940 | Tratsch | 133/3 D |
| 2,903,117 | 9/1959 | Kowaleski et al. | 194/102 X |
| 3,174,608 | 3/1965 | Knickerbocker | 194/102 X |
| 3,884,330 | 5/1975 | Chalabian | 194/59 |
| 4,062,435 | 12/1977 | Chalabian | 194/54 |

*Primary Examiner*—F. J. Bartuska

*Attorney, Agent, or Firm*—Smyth, Pavitt, Siegemund, Jones & Martella

[57] ABSTRACT

A coin selecting funnel for use in a coin-operated vending machine, for receiving coins inserted into the machine through a slot, for routing coins larger than a certain diameter into a descending a coin chute, and for routing coins smaller than that certain diameter into a coin return passage includes a trough having a wall and a ledge which interest along a vertex oriented so that inserted coins are conducted downwardly from a coin slot to a coin chute, the coins passing along the wall with their faces flush to the wall and their edges supported by the ledge. The wall contains an aperture having an upper edge extending parallel to the vertex of said trough and spaced from the vertex by a distance exceeding that certain diameter. The aperture also includes a lower edge extending parallel to the vertex and spaced from the vertex by a distance less than half that certain diameter. As inserted coins pass along the wall, coins smaller than that certain diameter will topple over the edge of the aperture into a coin return passage and coins larger than that certain diameter will be supported by the upper and lower edges of the aperture so as to be conducted along the trough to the coin chute.

2 Claims, 3 Drawing Figures

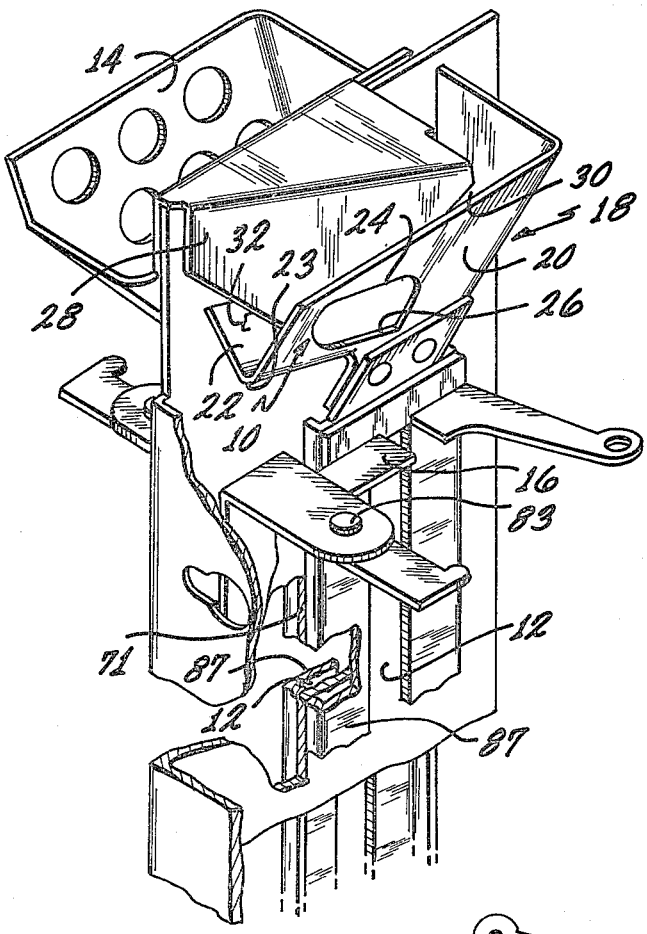
Fig. 1
Fig. 2
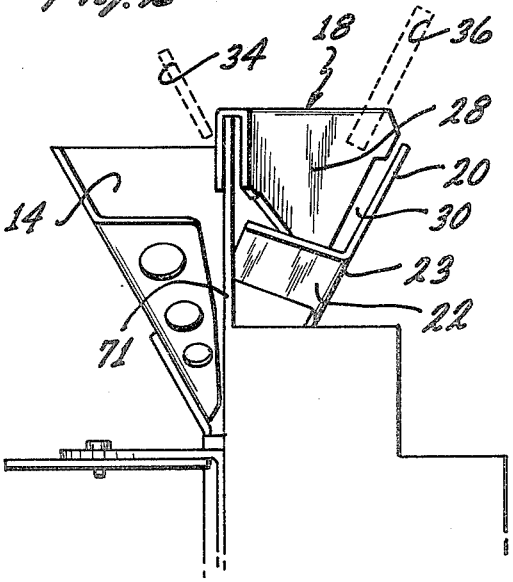
Fig. 3
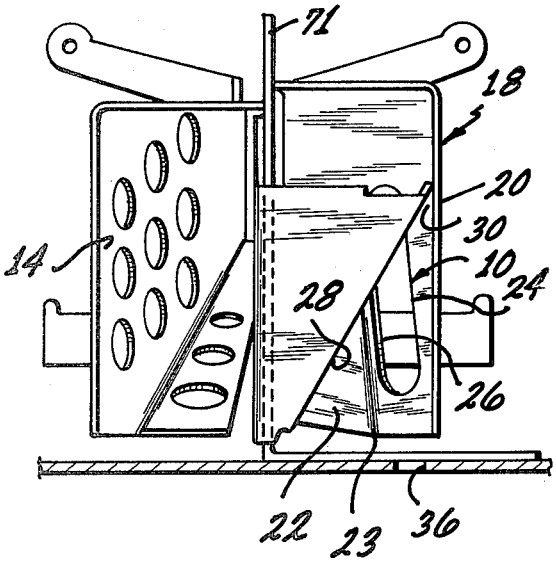

COIN SELECTING FUNNEL

BACKGROUND OF THE INVENTION

1. Field of the Invention

The present invention is in the field of coin operated vending machines and more specifically relates to a coin selecting funnel for use in such machines for receiving coins inserted into the machine through a slot, for routing coins larger than a certain diameter into a coin chute and for routing coins smaller than that certain diameter into a coin return passage.

2. The Prior Art

The present invention is an improvement over the funnel described in U.S. Pat. No. 4,062,435 issued Dec. 13, 1977 to Chalabian, and assigned to the assignee of the present invention. In that patent, there is shown and described a coin funnel which is provided with a plurality of apertures so that if moisture should get into the machine it will not be funneled into the coin chute but instead will fall through the apertures to the bottom of the machine where it will do no damage. The apertures advantageously reduce the area of contact between the coin and the funnel so that if a wet coin is inserted into the machine, the surface tension between the coin and the funnel will be significantly reduced thereby keeping the wet coin from sticking in the funnel. Also, as the coins cross the apertures in the wall of the funnel, water will tend to be stripped from the coins as they pass over the edges of the apertures, so that a large part of the water will be stripped from the coins and the coins will be less wet by the time they reach the coin chute.

Although the design of the funnel of the present invention gives it a superior capability for operation with wet coins, the coin selecting funnel of the present invention is designed to cope with a different problem.

The type of coin operated vending apparatus in which the present invention is used is described in U.S. Pat. No. 3,884,330 issued May 20, 1975 to Chalabian and assigned to the assignee of the present invention. In that patent, there is described a coin operated vending machine in which the inserted coins stack up edge-to-edge tangentially within a coin chute; the height of the stack of coins equaling the sum of the diameters of the coins. Normally, there are two coin chutes, one for dimes, and the other receiving nickels and quarters. In practice, a few customers inadvertently insert dimes or pennies into the slot reserved for nickels and quarters. The erroneous coins and any other foreign matter inserted into the slots will be rejected and returned to the customer when he attempts to open the door of the machine, as described in U.S. Pat. No. 3,884,330. However, it has been observed that a certain number of pennies, when stacked in the chute reach a height sufficiently close to the height reached by a different number of quarters, so that the machine can be operated by pennies rather than by quarters. Because the knowledge of this circumstance is relatively easily obtained, a countermeasure must be built into the machine. The present invention thus is a countermeasure to prevent the customers from defeating the machine by inserting pennies instead of quarters.

SUMMARY OF THE INVENTION

In accordance with the present invention, there is provided a coin selecting funnel for conducting the inserted coins from the coin slot to the coin chute and which passes quarters, but which rejects pennies and dimes by short-circuiting them around the coin chute to a coin return box. Because the coin operated vending apparatus operates on the sum of the diameters of the inserted coins, the rejection of pennies and dimes, but not quarters is done on the basis of the diameters of the inserted coins.

In accordance with the present invention, there is provided a descending trough for receiving the coins that have been inserted through the quarter slot and for conducting the inserted coins to the top of the coin chute. The coins are caused to roll on their edges down the inclined trough while leaning against one of the walls of the trough. That wall includes an aperture whose height, measured from the vertex of the trough is chosen to be greater than the diameter of the coins to be rejected but less than the diameters of the coins to be conducted to the coin chute. Upon reaching the aperture, the coins to be rejected are no longer supported by the wall of the trough, while the coins to be accepted continue to be supported by the portion of the wall of the trough that lies immediately above the upper edge of the aperture. In a preferred embodiment, a deflector is mounted within the trough and it operates to throw the inserted coins against the wall having the aperture.

In one embodiment, the trough is mounted to a pivotable wall of the coin chute while the deflector is mounted to a fixed wall of the coin chute. Sufficient space is left between the walls of the trough and the deflector to permit the trough to pivot with respect to the deflector when the chute is opened.

The novel features which are believed to be characteristic of the invention, both as to its structure and method of operation, together with further objects and advantages thereof, will be better understood from the following description considered in connection with the accompanying drawings in which a preferred embodiment of the invention is illustrated by way of example. It is to be expressly understood, however that the drawings are for the purpose of illustration and description only and are not intended as a definition of the limits of the invention.

BRIEF DESCRIPTION OF THE DRAWINGS

FIG. 1 is a fractional perspective view of the top portion of the coin chute assembly showing a preferred embodiment of the coin selecting funnel of the present invention;

FIG. 2 is a front elevation view of the invention shown in FIG. 1; and,

FIG. 3 is a top view of the embodiment shown in FIG. 1.

DETAILED DESCRIPTION OF THE PREFERRED EMBODIMENT

Turning now to the drawings, in which like parts are denoted by the same reference numeral throughout, there is shown in FIG. 1 a perspective view of a preferred embodiment of the present invention as it is related to the descending coin chute 12. The structure of the coin chute 12 as well as the structure of the water proof funnel 14 used on the dimes side of the machine are described in U.S. Pat. Nos. 3,884,330 and 4,062,435 referred to above. The disclosure of those patents is incorporated herein by reference, and reference to those patents will promote understanding of the present invention.

The coin chute 12 on the quarters side of the machine includes a space through which the coins descend. The space is enclosed between the central wall 71 and a pivotable wall 87 that has a bracket-shaped cross section. The pivotable wall 87 is connected by the arm 16 to the pivot point 83 about which the wall 87 pivots. The trough 18 is connected to the pivotable wall 87 and pivots with it about the pivot point 83 as indicated in FIG. 1. The trough 18 includes a wall 20 and a ledge 22, which intersect along the vertex 23 of the trough. As shown in the front view of FIG. 2, the vertex 23 is inclined downwardly from front to back so that the coins will roll on their edges downwardly along the trough 18.

In accordance with the present invention, the wall 20 is provided with an aperture 10 having an upper edge 24 and a lower edge 26. In a preferred embodiment of the present invention, a deflector 28 is mounted within the trough 18. The deflector 28 does not extend to contact either the wall 20 or the ledge 22. Instead, a space 30 is left between the deflector 28 and the wall 20 for the coins to pass through. Likewise, a space 32 is provided between deflector 28 and the ledge 22 to permit clearance when the trough 18 is pivoted away from the central wall 71.

In FIG. 2, the location of the dime slot 34 and the slot 36 used for quarters and nickels are indicated by dashed lines.

In operation, the coins inserted through the slot 36 fall into the space between the deflector 28 and the wall 20, and if a coin does not immediately position itself against the wall 20, it will be forced to do so by the deflector 28 which is angled to deflect the coins against the wall 20. The coins then roll downwardly along the vertex of the trough with the edge of the coin in contact with the ledge 22 and the face of the coin flush against the wall 20. The lower edge of a coin is prevented from slipping out through the bottom of the trough by the portion of the wall 20 between the vertex 23 and the lower edge 26 of the aperture 10. The lower edge 26 of the aperture 10 extends parallel to the vertex 23 and is spaced from it by a distance less than half the diameter of the smallest coin to be rejected. The upper edge 24 of the aperture 10 also extends parallel to the vertex 23 and is spaced from it by a distance which is larger than the diameter of the largest coin to be rejected but which is smaller than the diameter of the smallest coin which is to be accepted.

When one of the coins that is to be rejected is inserted through the slot 36 and subsequently passes along the wall 20, upon reaching the aperture 10, the upper edge of the coin is no longer supported by the upper edge 24 of the aperture, and because the center of gravity of the coin is to the right of the lower edge 26, the coin topples over the lower edge 26 leaving the trough by passing downwardly through the aperture 10 into the space adjacent to the pivotable wall 87, which is referred to as the coin return passage. Such coins do not enter the coin chute 12. On the other hand, when a coin larger in diameter than the space between the vertex 23 and the upper edge 24 of the aperture is inserted through the slot 36, and subsequently rolls along the wall 20, upon reaching the aperture 10, the upper edge of the coin is prevented from falling through the aperture by the upper edge 24 of the aperture. The coin then passes along the wall 20 and is thereby conducted to the coin chute 12.

In addition to rejecting certain coins on the basis of their diameters, the aperture 10 in the wall 20 produces some of the beneficial effects obtained by the apertures in the waterproof funnel 14 normally employed on the dime side of the machine. The aperture 10 reduces the area of contact between a wet coin and the wall 20 and additionally provides a wiping action which tends to remove some of the moisture from the coin.

Thus, there has been described a coin selecting funnel for use in a coin operated vending machine, which routes coins smaller than a certain diameter into a coin return passage and which routes other coins larger than that certain diameter into the coin chute.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A coin selecting funnel for use in a coin operated vending machine for receiving coins inserted into the machine through a slot, for routing coins larger than a certain diameter into a descending coin chute and for routing coins smaller than that certain diameter into a coin return passage, the descending coin chute including a stationary wall and a pivotable wall adapted to be pivoted away from the stationary wall to selectively open the descending coin chute, said coin selecting funnel comprising:

a trough including a non-vertical wall and a ledge which intersect along a vertex, the trough and vertex descending from an upper end of the trough positioned at a point below the slot to a lower end of the trough positioned at the top of the descending coin chute, said trough being affixed to the pivotable wall of the descending coin chute to pivot with it;

a deflector having a deflector surface with the deflector affixed to the stationary wall of the descending coin chute and extending into said trough with the deflector surface positioned to deflect coins passing through said trough such that one of the coin faces is moved into sliding engagement with the non-vertical wall while the coin edge contacts and is supported by said ledge;

said deflector extending from a fixed connection with the stationary wall at an angle which opens in the direction of descent of the trough toward the coin chute and also opens in the direction of said non-vertical chute wall;

said deflector having a forward end which is spaced from the non-vertical chute wall such that coins within the chute may pass through the space after being deflected into sliding contact with said non-vertical wall;

said pivotable wall being pivoted about a pivot axis which is positioned adjacent the upper end of the trough such that pivoting of the wall pivots the lower end of the trough away from the stationary wall;

said deflector having a lower edge that is spaced from said trough;

the spacing between said lower edge and the trough being greatest near the upper end of the trough and least near the lower end of the trough;

said non-vertical wall including an aperture having an upper edge extending parallel to the vertex of said trough and spaced from the vertex by a distance exceeding that certain diameter, said aperture including a lower edge extending parallel to the vertex of said trough and spaced from the vertex by a distance less than half that certain diameter, said aperture extending along said trough beyond said deflector so that coins smaller than that certain diameter will topple over the lower edge of said aperture through said non-vertical wall into the coin return passage and coins larger than that certain diameter will be supported by the upper and the lower edges of said aperture so as to be conducted along said trough to said descending coin chute, and the spacing between said lower edge and said trough providing free pivotal movement of said pivotable wall about said pivot axis without interference of the deflector with said trough as the coin chute and coin selecting funnel are opened.

2. The coin selecting funnel of claim 1 wherein said deflector surface is positioned in a generally vertical direction, and said ledge is angled to cooperate with the said lower edge of the deflector to provide free pivotal movement of the pivotable wall without interference between the deflector and said trough.

* * * * *